US006189464B1

(12) United States Patent
Okazaki et al.

(10) Patent No.: US 6,189,464 B1
(45) Date of Patent: Feb. 20, 2001

(54) PULVERIZED COAL COMBUSTION BURNER AND COMBUSTION METHOD THEREBY

(75) Inventors: Hirofumi Okazaki; Hironobu Kobayashi, both of Hitachi; Toshikazu Tsumura; Kenji Kiyama, both of Kure; Tadashi Jimbo, Kure; Kouji Kuramashi, Kure; Shigeki Morita, Kure; Shinichiro Nomura, Osaka; Miki Shimogori, Kure, all of (JP)

(73) Assignees: Hitachi, Ltd.; Babcock-Hitachi Kabushiki Kaisha, both of Tokyo (JP)

( * ) Notice: Under 35 U.S.C. 154(b), the term of this patent shall be extended for 0 days.

(21) Appl. No.: 09/238,161

(22) Filed: Jan. 28, 1999

(30) Foreign Application Priority Data

Jan. 30, 1998 (JP) ..... 10-018433

(51) Int. Cl.[7] ..... F23B 7/00
(52) U.S. Cl. ..... 110/347; 110/263; 110/265
(58) Field of Search ..... 110/104 B, 260, 110/261, 262, 263, 264, 265, 347

(56) References Cited

U.S. PATENT DOCUMENTS

| | | | | |
|---|---|---|---|---|
| 4,545,307 | | 10/1985 | Morita et al. | 110/264 |
| 4,807,541 | * | 2/1989 | Masai et al. | 110/262 |
| 4,907,962 | * | 3/1990 | Azuhata et al. | 110/262 X |
| 5,231,937 | * | 8/1993 | Kobayashi et al. | 110/262 |
| 5,411,394 | * | 5/1995 | Beer et al. | 110/262 X |
| 5,680,823 | * | 10/1997 | LaRose | 110/262 |
| 5,685,242 | * | 11/1997 | Narato et al. | 110/262 |
| 5,829,369 | * | 11/1998 | Sivy et al. | 110/261 X |
| 5,937,770 | * | 8/1999 | Kobayashi et al. | 110/261 X |

FOREIGN PATENT DOCUMENTS

| | | |
|---|---|---|
| 445 938 | 9/1991 | (EP) . |
| 1-305206 | 12/1989 | (JP) . |
| 3-110308 | 5/1991 | (JP) . |
| 3-211304 | 9/1991 | (JP) . |
| 9-170714 | 6/1997 | (JP) . |
| WO95/13502 | 5/1995 | (WO) . |

* cited by examiner

*Primary Examiner*—Ira S. Lazarus
*Assistant Examiner*—Ljiljana V. Ciric
(74) *Attorney, Agent, or Firm*—Mattingly, Stanger & Malur

(57) ABSTRACT

A combustion method utilizing a pulverized coal combustion burner which is provided with a pulverized coal nozzle for jetting a fluid mixture of pulverized coal and air and an air nozzle for jetting air. In the method, a combustion flame formed by the pulverized coal combustion burner forms a first zone of a gas phase air ratio of one or less at a radially central portion of the flame and a second zone of a gas phase air ratio of more than one outside of the first zone adjacent the coal nozzle, and a third zone of a gas phase air ratio of one or less at a downstream side from said first and second zones.

5 Claims, 9 Drawing Sheets

PULVERIZED COAL COMBUSTION BURNER AND COMBUSTION METHOD THEREBY

BACKGROUND OF THE INVENTION

The present invention relates to a pulverized coal combustion burner and a combustion method utilizing such a burner and, more particularly, to a combustion method using a pulverized coal combustion burner which pneumatically transfers and burns pulverized coal.

Hitherto, in this kind of pulverized coal combustion burners, occurrence of NOx during combustion is a large problem. Particularly, coal has a larger content of nitrogen, compared with gaseous fuel and liquid fuel. Therefore, it is more difficult to decrease NOx produced by combustion of pulverized coals than in the case of combustion of gaseous fuel or liquid fuel.

NOx produced by combustion of pulverized coal is almost all NOx that is produced by oxidizing nitrogen contained in coal, that is, so-called fuel NOx. In order to decrease the fuel NOx, various burner structures and combustion methods have been studied.

As one of the burning methods, there is a method of forming a low oxygen concentration zone within a flame and utilizing reducing reaction of NOx which becomes active when the oxygen concentration is low. For example, JP A 1-305206, JP A 3-211304, JP A 9-170714, JP A 3-110308, disclose methods of producing flame (reducing flame) of low oxygen concentration atmosphere and completely burning coal, and a structure having a fuel nozzle for pneumatically transferring coal at the center thereof and an air injecting nozzle arranged outside the fuel nozzle. In these methods, a low oxygen concentration zone is formed inside the flame, reducing reactions of NOx are progressed in the reducing flame zone, and an amount of NOx occurred within flame is suppressed.

Further, JP A 3-211304, JP A 9-170714 and JP A 3-110308 disclose formation of recirculating flows at a downstream side of the tip of a pulverized coal nozzle by providing a flame stabilizing ring or obstacle at the tip of the pulverized coal nozzle. That is, since a high temperature gas stays inside the recirculating flows, ignition of pulverized coals progresses and the stability of flame can be raised.

In general, since the ignitability of coal is not better than other fuel, it is difficult to raise the ignitability of the coal even if the above-mentioned various methods are adopted. Therefore, in combustion of coal, consumption of oxygen does not progress and a reducing zone is hard to be formed. In order to form a reducing zone, it is necessary to suppress mixing of fuel and air jetted from an air nozzle in the vicinity of the pulverized coal nozzle. The the mixing with fuel is suppressed by supplying the air to be supplied from the air nozzle in a swirling flow. However, when strong swirling is imparted to air, mixing of the air and fuel does not progress even at a downstream portion (more than three times as large as the diameter of a burner throat) separated from the burner due to centrifugal force, and it is hard to effect complete combustion. Therefore, in this kind of pulverized coal combustion, there is the problem that NOx occurs and unburned carbons are left in combustion ashes of pulverized coal.

SUMMARY OF THE INVENTION

The present invention is directed to solving the above-mentioned matters, and an object of the present invention is to provide a pulverized coal combustion burner by which an amount of occurrence of NOx is small and unburnt carbons left in combustion ashes of pulverized coal is small, and to provided a combustion method utilizing the pulverized coal combustion burner.

The present invention attains the above object by a combustion method utilizing a pulverized coal combustion burner comprising a pulverized coal nozzle for injecting a mixture of pulverized coal and air and an air nozzle, provided at an outer peripheral portion of the pulverized coal nozzle so as to surround the pulverized coal nozzle, for injecting air, wherein combustion flame formed by the pulverized coal burner has a zone of a gas phase air ratio of 1 or less formed at a radially central portion of the flame and a zone of a gas phase a air ratio of larger than 1 formed outside the zone in the vicinity of an injection port of the pulverized coal combustion burner, and a zone of a gas phase air ratio of 1 or less formed inside the flame at a downstream side.

Further, in a combustion method utilizing a pulverized coal combustion burner provided with a pulverized coal nozzle for injecting a mixture of pulverized coal and air and an air nozzle, arranged at an outer peripheral side of the pulverized coal nozzle so as to surround the pulverized coal nozzle, for injecting air, the present invention is so made that a pulverized coal mixture fluid is jetted in a straight stream from the pulverized coal nozzle, an air is jetted from the air nozzle in a straight stream without being swirled or in a weak swirling stream of a swirl number of 0.8 or less in a direction separating from the pulverized coal nozzle at an angle of at least 30° but no more than 50° to the central axis of the pulverized coal nozzle, and a jetting speed of the air supplied from the air nozzle is larger than a jetting speed of the pulverized coal mixture fluid supplied from the pulverized coal nozzle.

Further, in this case, a ratio of a jetting speed of air jetted from the air nozzle to a jetting speed of the mixture fluid is in a range between 2:1 and 3:1.

Further, in a combustion method utilizing a pulverized coal combustion burner having a pulverized coal nozzle for injecting a mixture of pulverized coal and air and an air nozzle, provided at an outer peripheral portion of the pulverized coal nozzle so as to surround the pulverized coal nozzle, for injecting air, and an air supply means, arranged at a downstream side of the pulverized coal nozzle, for supplying second combustion air, and which is formed so as to effect two stage combustion, the method includes supplying a substoichiometric quantity of air, i.e., an amount less than that necessary for complete combustion of the fuel supplied from the pulverized coal nozzle and an air quantity in short supply thereby is supplied from the air supply means and combustion flame formed by the pulverized coal combustion burner before mixing with the second combustion air has a zone of a gas phase air ratio of 1 or less formed at a radially central portion and a zone of a gas phase air ratio of 1 or larger formed outside the zone in the vicinity of an injection port of the pulverized coal combustion burner, and a zone of a gas phase air ratio of 1 or less formed inside the flame at a downstream side.

Further, in a combustion method utilizing a pulverized coal combustion burner having a pulverized coal nozzle for injecting a mixture of pulverized coal and air and an air nozzle, provided at an outer peripheral portion of the pulverized coal nozzle so as to surround the pulverized coal nozzle, for injecting air, and an air supply means, arranged at a downstream side of the pulverized coal nozzle, for supplying second combustion air, and which is formed so as to effect two stage combustion, the method includes supplying a substoichiometric quantity of air, i.e., an amount less than that necessary for complete combustion of the fuel supplied from the pulverized coal nozzle, a pulverized coal mixture fluid is in a straight stream from the pulverized coal nozzle, a substoichiometric quantity of air from the air nozzle is supplied from the air supply means and an air is jetted from the air nozzle in a straight stream without being swirled or in a weak swirling stream of a swirl number of 0.8 or less in a direction separating from the pulverized coal nozzle at an angle of at least 30° 0 but no more than 50° to the central axis of the pulverized coal nozzle, and a jetting speed of the air supplied from the air nozzle is larger than a jetting speed of the pulverized coal mixture fluid supplied from the pulverized coal nozzle.

Further, the present invention, in a pulverized coal combustion burner provided with a pulverized coal nozzle for injecting a mixture of pulverized coal and air and an air nozzle, arranged at an outer periphery of the pulverized coal nozzle so as to surround the pulverized coal nozzle, for injecting air, is so made that the pulverized coal nozzle is formed so as to jet and supply a pulverized coal mixture fluid in a straight stream, the air nozzle is formed so as to jet air in a straight stream without being swirled or in a weak swirling stream of a swirl number of 0.8 or less in a direction separating from the pulverized coal nozzle at an angle of not less that 30° and no more than 50° to the central axis of the pulverized coal nozzle and so that a jetting speed of the air is larger than a jetting speed of the pulverized coal mixture fluid supplied from the pulverized coal nozzle.

Further, in a pulverized coal combustion burner provided with a pulverized coal nozzle for injecting a mixture of pulverized coal and air and an air nozzle, arranged at an outer peripheral side so as to surround the pulverized coal nozzle, for injecting air, a jet air guide plate having an angle of 30° to 50° to the central axis of the pulverized coal nozzle and guiding jet air to flow outward is provided at air jet outlet portion of the air nozzle.

Further, in this case, a downstream side end of the jet air guide plate is formed to be positioned on an extension line of a throat portion of an outer peripheral wall of the air nozzle or at a more radially outer side than the extension line. Further, an air flow passage side wall of the guide plate is formed in a smooth curved wall surface for air flow.

Further, in a pulverized coal combustion burner comprising a pulverized coal nozzle for jetting a mixture fluid of pulverized coal and primary air, a secondary air nozzle for jetting secondary air and a tertiary air nozzle for jetting tertiary air, each juxtaposed concentrically with and at an outer periphery of the pulverized coal nozzle, the pulverized coal nozzle is formed so as to jet and supply a mixture fluid of pulverized coal and primary air in a straight stream, the tertiary air nozzle is formed so as to jet tertiary air in a straight stream without being swirled or in a weak swirling stream of a swirl number of 0.8 or less, and an air jet outlet port is formed so as to jet tertiary air at an angle of at least 30° but no more than 50° to the central axis of the pulverized coal nozzle and so that a jetting speed of the air is larger than a jetting speed of the pulverized coal mixture fluid supplied from the pulverized coal nozzle.

With the pulverized coal combustion burner or in the combustion method mentioned above, combustion flame formed by the above-mentioned pulverized coal combustion burner has, in the vicinity of the jet port of the burner, a zone of a gas phase air ratio of 1 or less formed at a radially central portion of the flame and a zone of a gas phase air ratio of more than 1 formed outside the zone, so that oxygen is consumed by combustion reaction in the central portion of the pulverized coal flame and reducing flame of low oxygen concentration is formed. Since the concentration of fuel is low at the radial outside of the reducing flame, consumption of oxygen does not progress and oxidization flame of high oxygen concentration is formed. Further, since combustion is effected so that a uniform air ratio zone of a gas phase air ratio of 1 or less and a variation range of the gas phase air ratio of 0.2 or less is formed inside the flame at a downstream side, air jetted from the air nozzle and pulverized coal flowing at a central portion of the flame are mixed with each other at a flame rear stage portion. Since oxygen consumption has progressed in the flame front stage portion of reducing frame and oxidizing flame, the reducing flame of a low oxygen concentration spreads radially in the flame rear stage portion, therefore, the majority of the pulverized coal passes in the reducing zone, so that NOx occurred by the oxidizing flame in the flame front stage portion also is reduced. Moreover, an air distribution becomes uniform, a zone of an extremely low gas phase air ratio is not formed. Therefore, combustion reaction progresses, and it is possible to improve the combustion efficiency and reduce unburned carbons in combustion ashes.

DESCRIPTION OF THE EMBODIMENTS

EMBODIMENT 1

Figure 1:
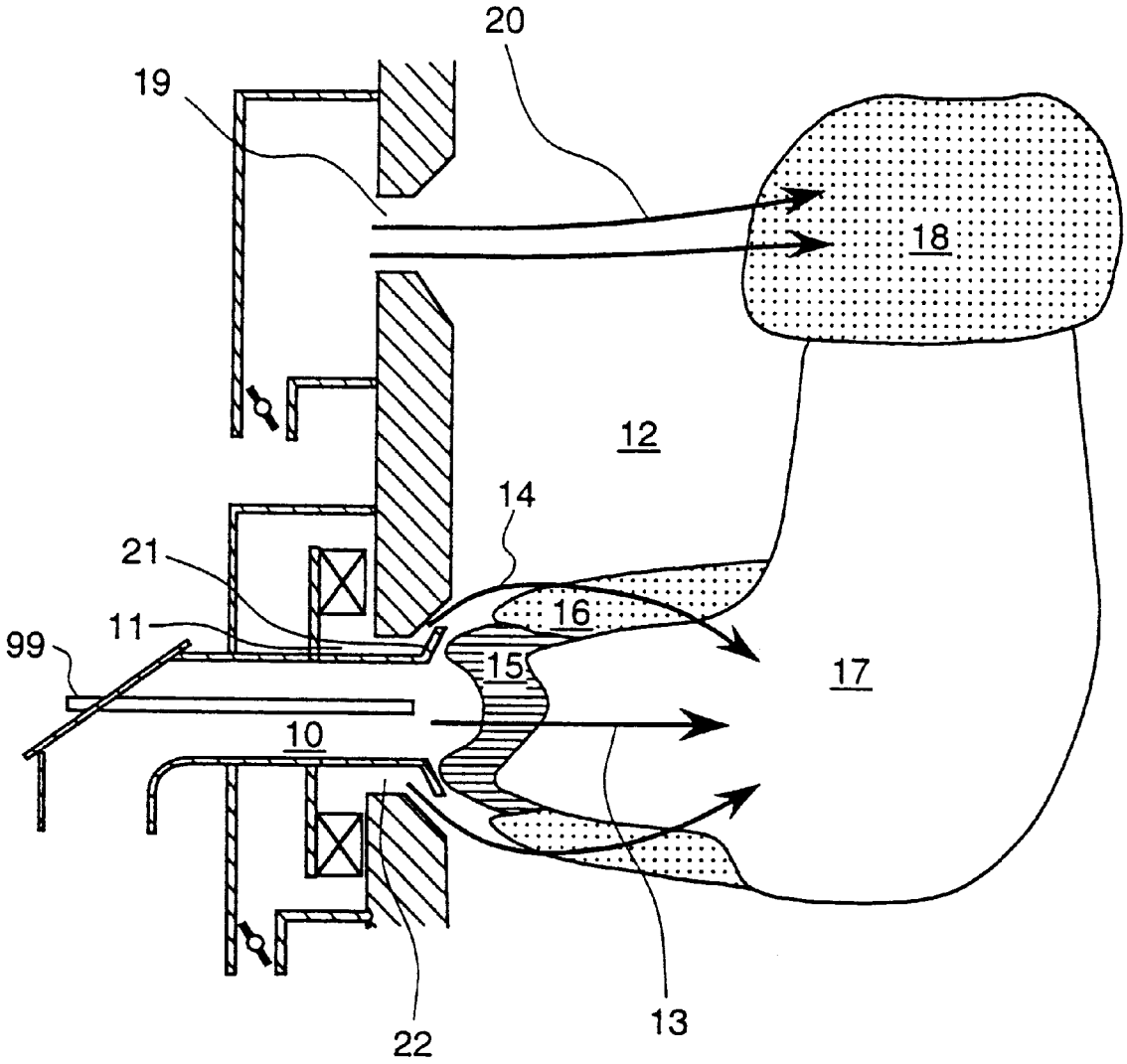
FIG. 1 is a vertical sectional side view of an embodiment of a pulverized coal combustion burner of the present invention.
Figure 2:
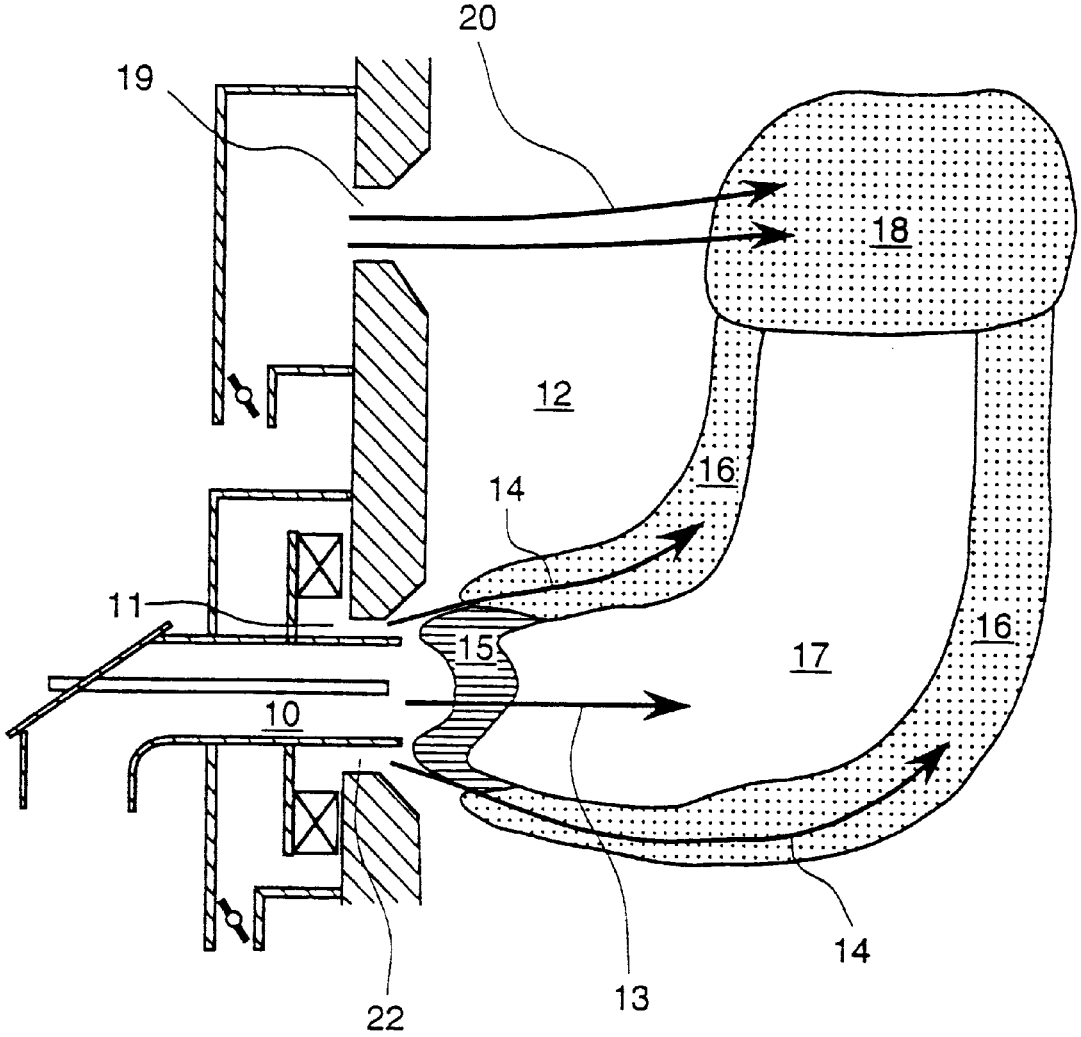
FIG.2 PRIOR ART
FIG. 2 is a vertical sectional side view of a conventional pulverized coal combustion burner.

A first embodiment of the present invention will be described hereunder, referring to FIGS. 1 and 2. FIG. 1 is a schematic view of a pulverized coal combustion burner of the first embodiment of the present invention, and FIG. 2 is a schematic view showing a conventional burner for comparison with the pulverized coal combustion burner shown in FIG. 1.

A reference number 10 denotes a pulverized coal nozzle for pneumatically transferring pulverized coal, the upstream side of which is not shown but connected to a transfer conduit. A reference number 11 is an air nozzle provided outside the pulverized coal nozzle 10, a reference number 12 denotes a furnace space for combustion of pulverized coal and air jetted from the pulverized coal combustion burner. An arrow 13 shows a stream of pulverized coal jetted from the pulverized coal nozzle 10 and an arrow 14 shows a stream of air jetted from the air nozzle 11. A reference number 99 denotes an oil gun provided for assisting combustion.

In this first embodiment, a method (two stage combustion method) is employed wherein a substoichiometric quantity of air supplied from the burner is slightly less than a quantity of air necessary for effecting complete combustion of pulverized coal and the remainder of the necessary air is supplied at a downstream side. A reference number 19 denotes an air supply means therefor, that is, an air nozzle for second stage combustion, and a reference number 20 denotes an air stream supplied therefrom. A reference number 18 denotes a combustion zone of second stage combustion air and pulverized coal supplied from the burner.

In this embodiment, air jetted from the air nozzle 11 is jetted out from the burner, and then flows separately from the center of a flame at a front stage portion of the flame and then flows toward the center of the flame at a rear stage portion of the flame (at a separate position from the burner nozzle outlet by more than a distance of three times as long as a burner throat diameter). Therefore, mixing of air jetted from the air nozzle 11 and pulverized coal flowing at the center of the flame is suppressed in the flame front stage portion, and at a downstream side of an ignition zone 15, oxygen is consumed at the central portion of pulverized coal flame by combustion reaction and reducing flame 17 of low oxygen concentration is formed.

Further, consumption of oxygen does not progress because of low fuel concentration at a radially outside portion of the reducing flame 17, so that an oxidizing flame 16 of high oxygen concentration is formed. Further, mixing of air jetted from the air nozzle 11 and pulverized coal flowing at the central portion of the flame in the rear stage portion of the flame spreads radially the reducing flame of low oxygen concentration in the flame rear stage portion because oxygen consumption has progressed in the flame front stage portion composed of the reducing flame and the oxidizing flame.

In the present invention, a radial direction of flame means a direction crossing an arrow 13 at right angles, which arrow shows a direction of a pulverized coal flow. It is a flame expansion direction in a radial direction of the burner.

In this manner, in order to cause a flow of the air jetted from the air nozzle to separate from the central axis in the flame front stage portion and then mix with the pulverized coal flow flowing at the center at the flame rear stage portion, the air is jetted in a direction separate from the pulverized coal nozzle at an angle of not less than 30° but no more than 50° to the central axis of the pulverized coal nozzle so as to be in a straight flow or in a weak swirling flow of a swirl number of 0.8 or less. Here, the swirl number can be obtained from the following equation:

Swirl number=(momentum in a swirling direction)÷(axial momentum×throat outer diameter).

In comparison with the first embodiment shown in FIG. 1, in a conventional pulverized coal burner shown in FIG. 2, air is jetted from an air nozzle 11 in a swirling flow swirled by strong swirling force of swirl number of 0.8 or more, so that the air after being jetted flows separately from the center and it is not mixed with a central portion even in the flame rear stage portion. Therefore, it has been separated into reducing flame 17 at the flame central portion and oxidizing flame 16 at the outside thereof, even in the flame rear stage portion.

Figure 3:
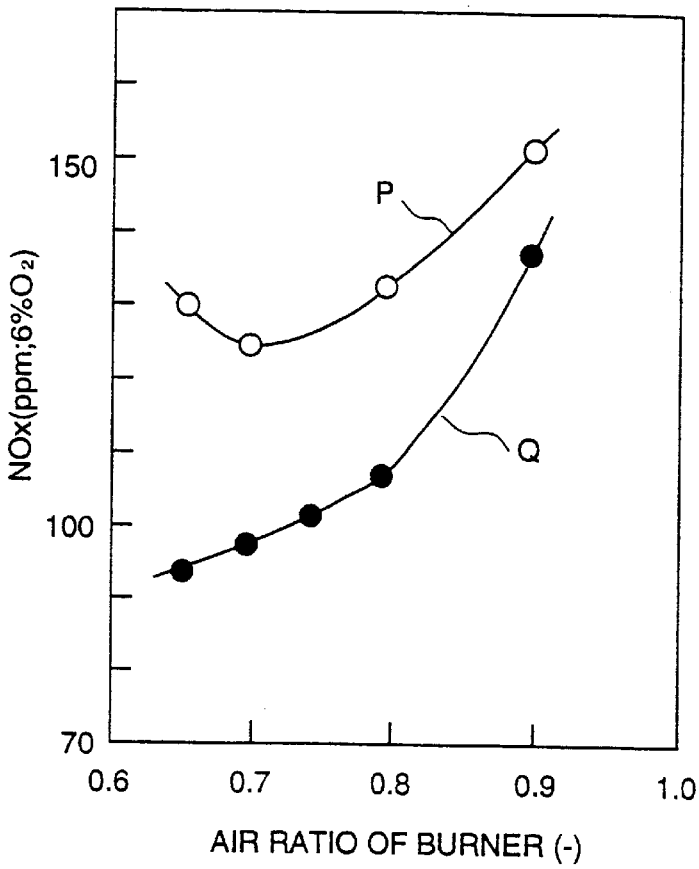
FIG. 3 is a diagram showing examination results by the pulverized coal combustion burner of the present invention and the conventional pulverized coal combustion burner.

In FIG. 3, there is shown an examination result of a relation between a ratio (abscissa) of an air quantity and a pulverized coal quantity and the concentration (ordinate) of NOx at the furnace outlet. A curve P shows the performance of the conventional pulverized coal burner and a curve Q the performance of the pulverized coal combustion burner of the present embodiment shown in FIG. 1. As is apparent from the diagram, it will be noted that the pulverized coal combustion burner of the present invention has a relatively low occurrence ratio of NOx compared with the conventional burner irrespective of largeness of the air ratio.

In the conventional burner by which the oxidizing flame 16 and reducing flame 17 flow separately from each other, reduction reaction of NOx progresses in the reducing flame at the flame central portion and NOx emission is small. However, since NOx occurs in the oxidizing flame spreading radially outward of the reducing flame, a quantity of NOx emission from the whole flame becomes large. Further, in the reducing flame, in a case where a gas phase air ratio (a ratio between a real air quantity and an air quantity necessary for effecting complete combustion of gaseous components emitted from pulverized coal) is too low, for example, 0.6, combustion reaction is delayed, so that unburnt substances increase, and there is a fear that it causes a decrease in combustion efficiency and becomes a bar to effective use of combustion ashes due to an increase of unburnt carbons in combustion ashes.

As in the first embodiment, in the case of a method (two stage combustion method) in which an air quantity supplied from the burner is made less than that necessary for complete combustion of pulverized coal and the remainder of the necessary air is supplied downstream, since combustion of pulverized coal does not progress, NOx occurring at the portion mixing with air for second stage combustion increases.

On the contrary, in the previous embodiment of the present invention, reducing flame spreads in a radial direction in the flame rear stage portion. Therefore, the majority of pulverized coal passes in the reducing zone, so that NOx produced in the oxidizing flame of the flame front stage portion is also reduced. Further, as compared with the conventional burner, since an air distribution becomes uniform, a zone of a extremely low gas phase air ratio is not formed. Therefore, combustion reaction progresses more than the conventional burner example shown in FIG. 2, and the combustion efficiency is improved and unburnt carbons in combustion ashes are reduced. Further, since the combustion reaction of pulverized coal has progressed before mixing with air for second stage combustion, NOx occurring by mixing with the air for second stage combustion becomes small.

EMBODIMENT 2

Figure 4:
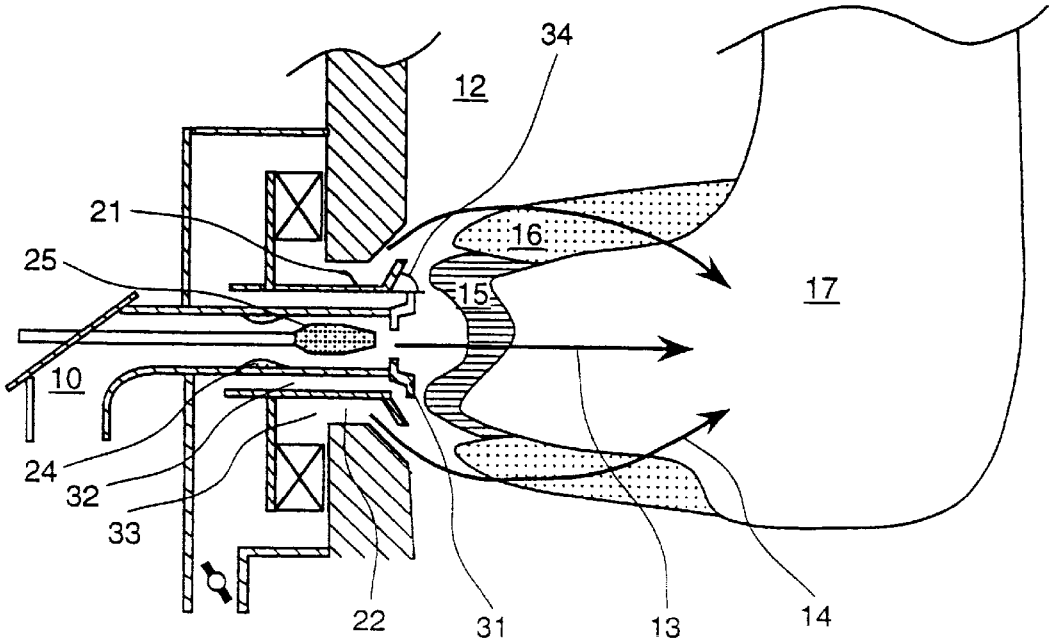
FIG. 4 is a vertical sectional side view of another embodiment of a pulverized coal combustion burner of the present invention.
Figure 5:
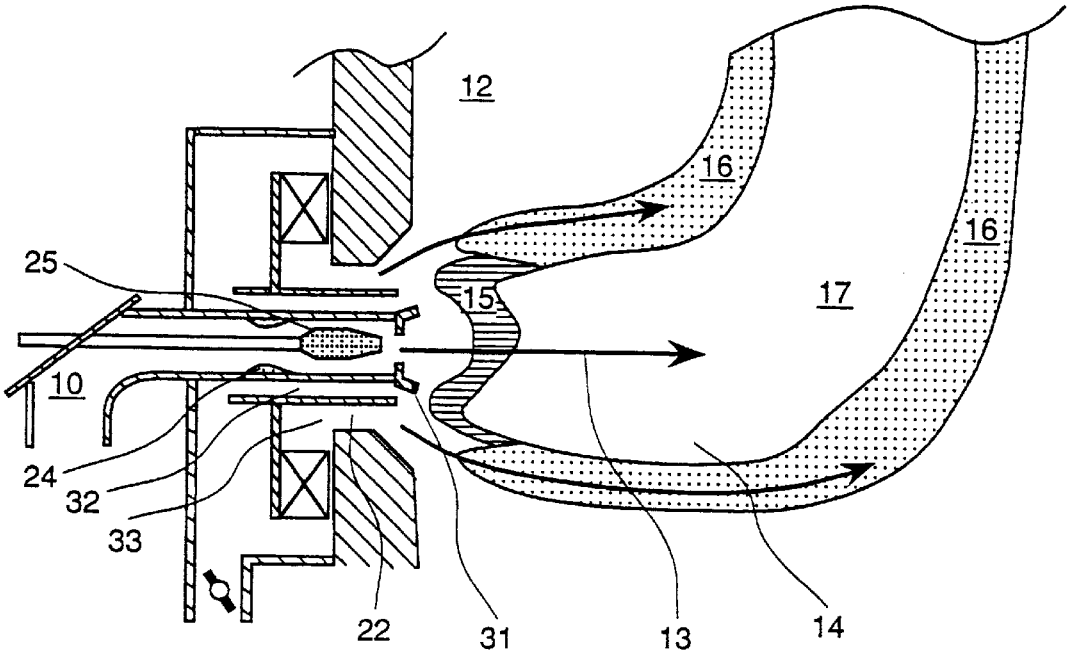
FIG.5 PRIOR ART
FIG. 5 is a vertical sectional side view of a conventional pulverized coal combustion burner.

FIG. 4 is a schematic view of a pulverized coal burner showing a second embodiment of the present invention. FIG. 5 is a schematic view of a conventional burner shown for comparison with the pulverized coal burner shown in FIG. 4. The second embodiment of the present invention will be described hereunder, referring to FIG. 4.

In FIG. 4, an air nozzle is separated into two, a secondary air nozzle 32 and a tertiary air nozzle 33. Here, the secondary air nozzle 32 serves to provide a spacing between the pulverized coal nozzle 10 and the tertiary air nozzle 33. In the case where the pulverized coal nozzle and the tertiary air nozzle are spaced from each other, the burner is damaged by burning and can not be used when secondary air is not flowed from the secondary air nozzle 32. Therefore, secondary air is flowed from the secondary air nozzle 32 as a cooling gas. A quantity of the secondary air is sufficient to be ⅓ the quantity of tertiary air. In order to flow secondary air along a guide plate 21 described later and distance it from the pulverized coal nozzle 10, a flame stabilizing ring 31 is utilized. That is, a tip portion of the flame stabilizing ring 31 extends outward 14 in the radial direction. Further, a venturi 24 and a spindle-shaped obstacle 25 are provided at a central portion of the pulverized coal nozzle 10. Since pulverized coal flows toward the outer periphery along the obstacle 25, the concentration of pulverized coal is raised in the vicinity of the flame stabilizing ring 31, whereby the pulverized coal is ignited earlier in the vicinity of the flame stabilizing ring 31 and a zone of reducing flame 17 expands. Further, the present embodiment shown in FIG. 4 differs from the conventional burner of FIG. 5 and is provided with the guide plate 21 on the wall, at the pulverized nozzle side, of the outlet of the tertiary air nozzle 33.

By this guide plate 21, the direction of tertiary air flowing in parallel with the central axis of the pulverized coal nozzle at the throat portion 22 is bent in a radially outer direction. The inclination angle 34 of the guide plate 21 to the central axis of the nozzle is set to 30°–50°. Therefore, the tertiary air is jetted from the burner at an angle of 30°–50° to the central axis of the pulverized coal nozzle.

After the tertiary air is jetted from the tertiary air nozzle, the air flows separately from the center of flame in the flame front portion and then flows toward the flame center in the flame rear stage portion (in the portion separate from the burner nozzle outlet by a distance of three times as long as the burner throat diameter), as shown by an arrow 14. In this manner, in the flame front stage portion, without mixing of the tertiary air jetted from the tertiary air nozzle and the pulverized coal flowing at the center of the flame, oxygen is consumed by combustion reaction at the central portion of the pulverized coal flame and reducing flame 17 of low oxygen concentration is formed, at a downstream side of an ignition zone 15.

Further, since oxygen consumption does not progress because of low fuel concentration at a radially outer side of the reducing flame 17, oxidizing flame 16 of high oxygen concentration is formed. Further, tertiary air jetted from the tertiary air nozzle 33 and pulverized coal flowing at the central portion of flame are mixed in the flame rear stage portion. At this time, since oxygen consumption has progressed in the flame front stage portion composed of the reducing flame 17 and oxidizing flame 16, reducing flame of low oxygen concentration spreads in the radial direction in the flame rear stage portion.

Since the reducing flame spreads radially in the flame in the flame rear stage portion, the majority of pulverized coal passes in the reducing zone, whereby NOx produced by oxidizing flame of the flame front stage is also reduced.

Further, as compared with the conventional burner, a distribution of air becomes uniform, so that a zone of extremely low gas phase air ratio is not formed. Therefore, combustion reaction progresses and improvement of combustion efficiency and reduction of unburnt carbons in combustion ashes are carried out, more than in the conventional burner shown in FIG. 5. Further, since combustion reaction of pulverized coal has progressed before mixing with second stage combustion air, NOx occurring by mixing with the second stage combustion air becomes small.

In this manner, in order to flow tertiary air from the tertiary air nozzle 33 to separate from the central axis in the flame front stage portion and mix it with pulverized coal flowing at the center in the flame rear stage portion, it is desirable to jet the above-mentioned tertiary air at an angle of 30°–50° to the central axis of the pulverized coal nozzle and supply the tertiary air in a straight stream or in a weak swirling stream. Thereby, since centrifugal force of the tertiary air is small, mixing with pulverized coal is promoted in the flame rear stage portion.

Further, it is desirable to jet the tertiary air at a higher speed than the pulverized coal flow jetted from the pulverized coal nozzle. At this time, the momentum of the tertiary air flow becomes larger than that of the pulverized coal flow, so that it becomes difficult for the jetting direction of tertiary air to be influenced by the pulverized coal flow. Therefore, it is suppressed to mix tertiary air and pulverized coal in the vicinity of the burner.

Figure 6:
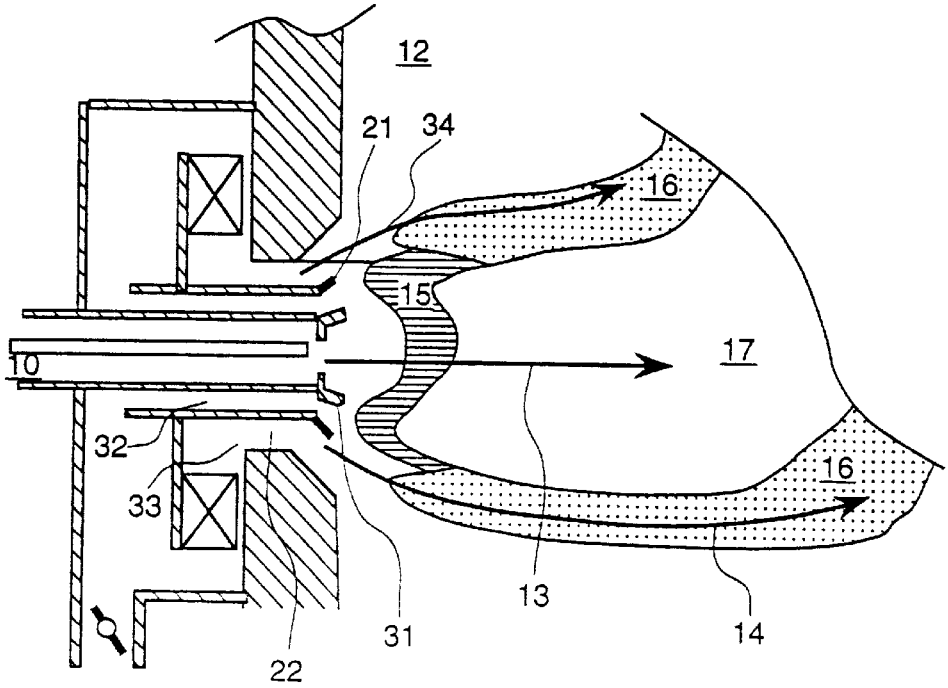
FIG.6 PRIOR ART
FIG. 6 is a vertical sectional side view of a conventional pulverized coal combustion burner.

Further, in the second embodiment shown in FIG. 4, the guide plate 21 is desirable to extend radially outward 14 more than an extension line of the outer peripheral wall of the throat portion 22 which has a flow path parallel with the central axis of the pulverized coal nozzle. Tertiary air flows in parallel with a pulverized coal flow and a jetting direction thereof is changed by the guide plate 21 in the throat portion. However, in the case where the guide plate is short as shown in FIG. 6, a flow, the direction of which is not changed by the guide plate as shown by an arrow 34 is formed, whereby the flow becomes easy to mix with the pulverized coal flow at a position close to the burner. With this construction, since the tertiary air and pulverized coal are mixed at an ignition time, a flame temperature is lowered and the ignition is delayed, whereby a reducing zone becomes difficult to be formed, so that the concentration of NOx at the furnace outlet increases.

Further, in the case where the air nozzle is separated radially into a plurality of air nozzles as in the present embodiment, since it is possible that an injection ratio of air is changed by the respective air nozzles, it is possible that an emission quantity of NOx and unburnt carbons in combustion ashes can be made suitable by adjusting a mixing position and mixing ratio of air and pulverized coal.

EMBODIMENT 3

Figure 7:
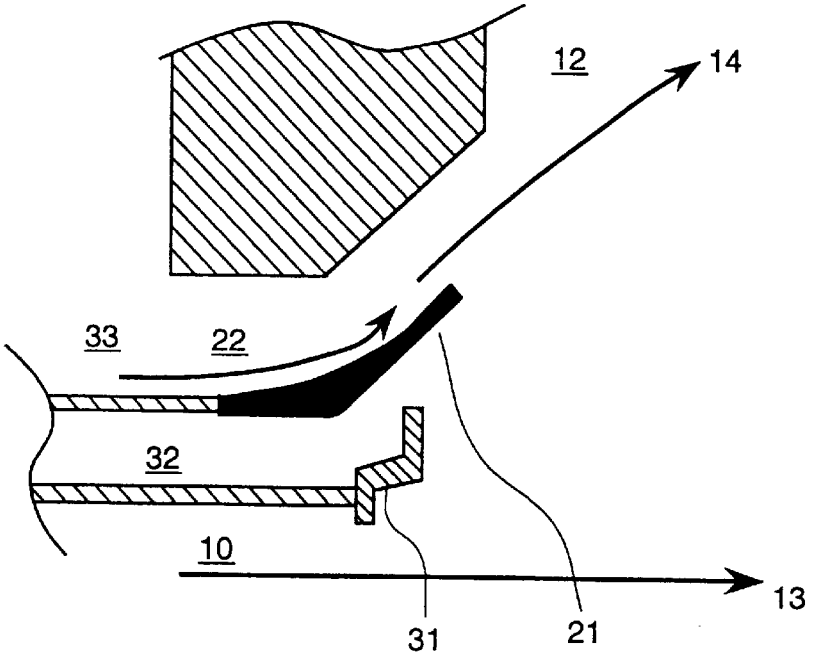
FIG. 7 is an enlarged side view of a main part of another embodiment of a pulverized coal combustion burner of the present invention.

FIG. 7 is an enlarged view of a nozzle portion of the pulverized coal burner showing a third embodiment of the present invention. In this embodiment, the guide plate 21 is provided on the wall of an outlet of a tertiary air nozzle 33 on the pulverized nozzle side. A flow path at the tertiary air nozzle side of the guide plate is formed to have a curved surface for the tertiary air flow so that the flow path changes smoothly. Further, in FIG. 8, an enlarged view of another pulverized coal nozzle portion is shown for explanation of the third embodiment.

Figure 8:
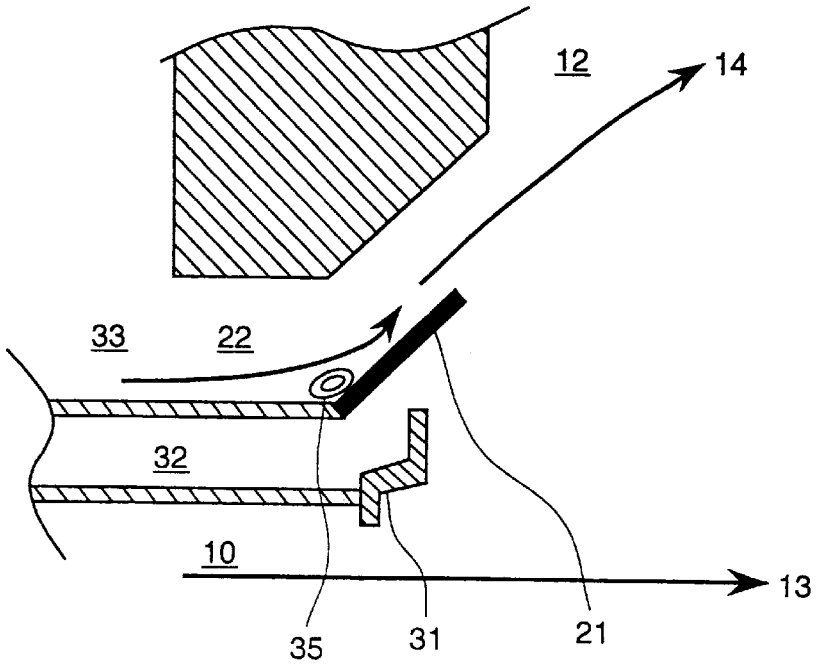
FIG. 8 is an enlarged side view of a main part of an embodiment of a pulverized coal combustion burner of the present invention.

In FIG. 8, when a flow course of the tertiary air flowing in the tertiary air nozzle is bent by the guide plate 21, a stay zone 35 in which the flow is delayed is formed at a connecting portion between the throat portion and the guide plate. The guide plate 21 is raised in temperature by radiation from the flame inside the furnace. The guide plate 21 is cooled by convection heat transfer of the air flowing there and heat conduction in the material constructing the guide plate. When the stay zone 35 is formed, the convection heat transfer in the stay zone decreases, so that the temperature of the guide plate rises and the possibility of burning damage increases.

The stay zone is not formed by smoothing the flow course as shown in FIG. 7. At this time, the guide plate 21 can be cooled by convection heat transfer of the air flow. Further, since the structural member of the connecting portion between the guide plate and the throat portion becomes thick, heat conduction in the structural member becomes more, whereby the temperature of the guide plate is suppressed from rising and the durability thereof can be raised.

EMBODIMENT 4

Figure 9:
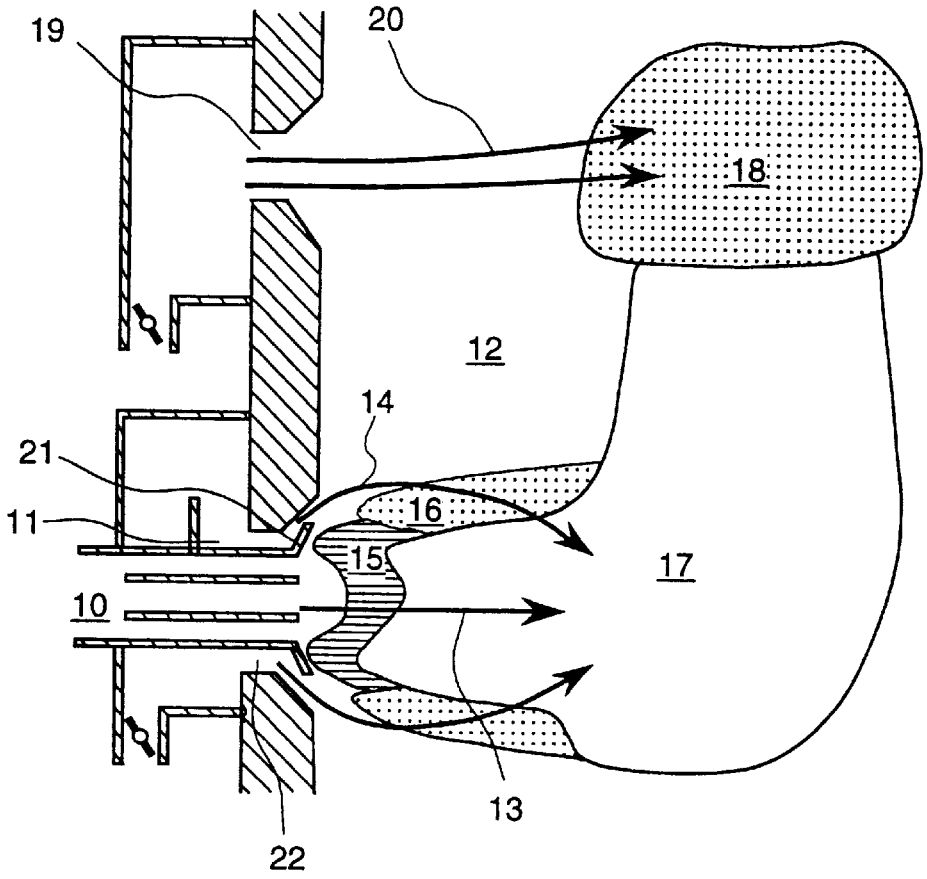
FIG. 9 is a vertical sectional side view of another embodiment of a pulverized coal combustion burner of the present invention.
Figure 10:
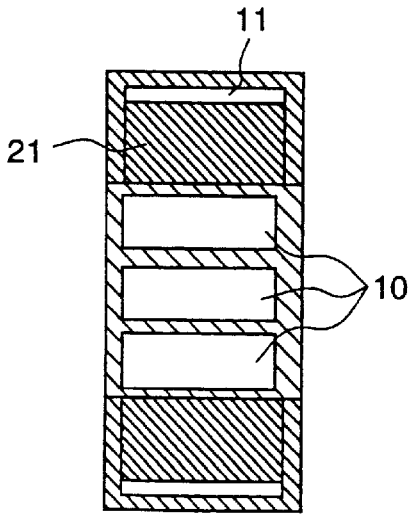
FIG. 10 is a front view of the pulverized coal combustion burner of FIG. 9.

FIG. 9 is a schematic view of a pulverized coal burner showing a fourth embodiment of the present invention. Further, FIG. 10 is a front view of the pulverized coal burner shown in FIG. 9, taken from a furnace side. In FIG. 9, a reference number 10 denotes a pulverized coal burner for pneumatically transferring pulverized coal, the upstream side of which is not shown but connected to a transfer conduit. A reference number 11 denotes an air nozzle provided so as to surround the pulverized coal burner. The pulverized coal nozzle 10 is divided into a plurality of nozzles and the air nozzle can be also divided into a plurality of air nozzles.

Further, a reference number 12 denotes a furnace space for combustion of pulverized coal and air jetted from the burner. An arrow 13 denotes a stream of pulverized coal jetted from the pulverized coal nozzle and an arrow 14 denotes a stream of air jetted from the air nozzle. Further, in this embodiment, a method (two stage combustion method) is used in which a quantity of air jetted from the burner is slightly less than the quantity of air necessary for complete combustion of pulverized coal, and the remainder of the necessary air is supplied downstream. A reference number 19 denotes an air nozzle for second combustion air, and an arrow 20 denotes a flow of the second stage combustion air. A reference number 18 denotes a combustion zone of second combustion air and pulverized coal supplied from the burner.

In the present embodiment, the air jetted from the air nozzle 11 flows separately from the center in the flame front stage portion and then flows toward the center of the flame in the flame rear stage portion (at a position separated from the burner outlet by a distance of three times as long as the burner throat diameter), after being jetted from the burner. Therefore, mixing of air jetted from the air nozzle 11 and the pulverized coal flowing at the center of flame is suppressed in the flame front stage portion, and in a downstream side of an ignition zone 15, oxygen is consumed by combustion reaction at the central portion of pulverized coal flame and reducing flame 17 of low oxygen concentration is formed.

Further, since oxygen consumption does not progress in a radially outer side of the reducing flame 17 because of low oxygen concentration, oxidizing flame 16 of high oxygen concentration is formed. Further, in the flame rear stage portion, when air jetted from the air nozzle 11 and pulverized coal flowing at the central portion of flame are mixed, since oxygen consumption has progressed in the flame front stage portion composed of the reducing flame and the oxidizing flame, the reducing flame of low oxygen concentration spreads in the radial direction in the flame rear stage portion.

In this manner, in order to flow air jetted from the air nozzle 11 separately from the central axis in the flame front stage portion and mix it with pulverized coal flowing at the center in the flame rear stage portion, the above-mentioned air is jetted at an angle of at least 30° but no more than 50° to the central axis of the pulverized coal nozzle.

In the embodiment shown in FIG. 9, the reducing flame spreading radially in the flame rear stage portion spreads inside the flame. Therefore, since the majority of pulverized coal passes in the reducing zone, NOx produced by the oxidizing flame of the flame front stage is also reduced. Further, a distribution of air becomes uniform as compared with the conventional burner, so that a zone of an extremely low gas phase air ratio is not formed. Therefore, combustion reaction progresses and improvement of combustion efficiency and reduction of unburnt carbons in combustion ashes are brought about. Further, since combustion reaction of pulverized coal has progressed before mixing with second stage combustion air, NOx occurring by mixing with the second stage combustion air becomes small.

EMBODIMENT 5

Figure 11:
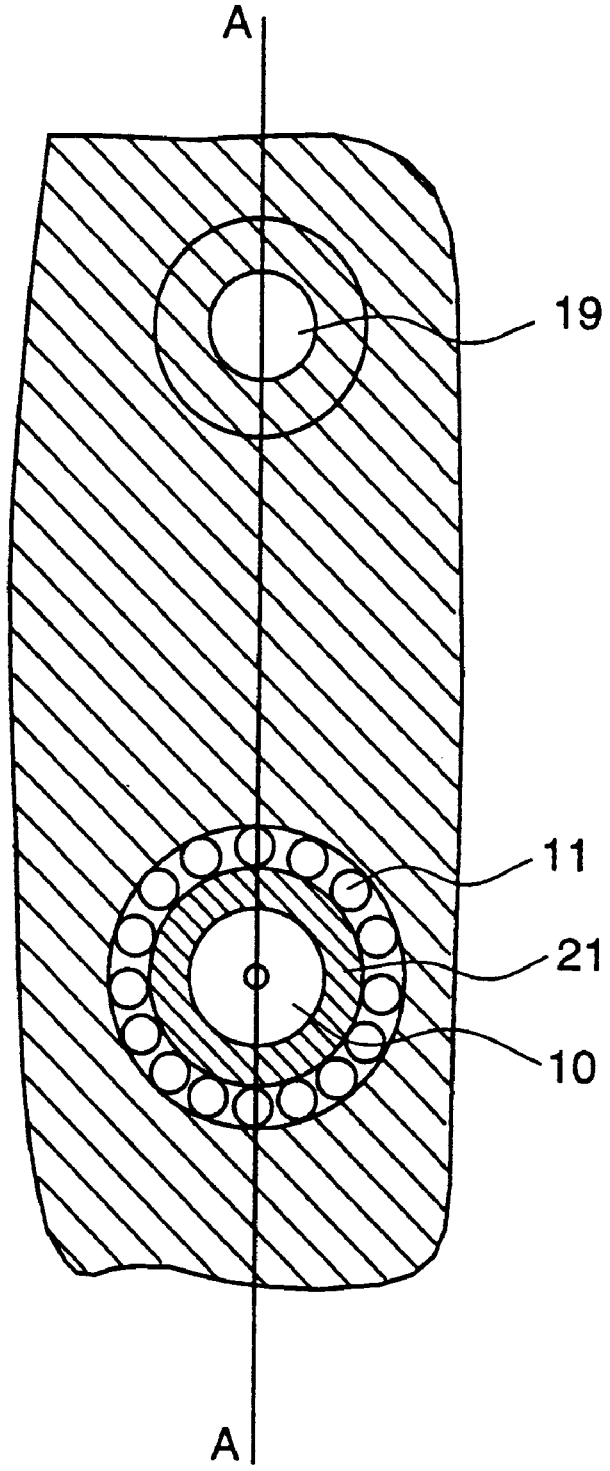
FIG. 11 is a front view of another embodiment of a pulverized coal combustion burner of the present invention.

FIG. 11 is a front view, of a pulverized coal burner showing a fifth embodiment, taken from a furnace side. A sectional view, taken along a line A—A, of the pulverized coal burner shown in FIG. 11 is the same as in FIG. 1. An air nozzle of the present embodiment is composed of a plurality of the air nozzles 11 and provided around the pulverized coal nozzle 10 so as to surround the nozzle 10. The outlet to the furnace of each air nozzle 11 is inclined at an angle of a least 30° but no more than 50° to the central axis of the pulverized coal nozzle, and air is jetted from the air nozzles 11 at an angle of at least 30° but no more than 50° to the central axis of the pulverized coal nozzle.

In this embodiment, the air jetted from the air nozzles 11 flows separately from the center in the flame front stage portion and then flows toward the center of the flame in the flame rear stage portion (at a position separated from the burner outlet by distance of three times as long as the burner throat diameter), as shown by an arrow 14 in FIG. 1, after being jetted from the burner. Therefore, mixing of air jetted from the air nozzles 11 and the pulverized coal flowing at the center of flame is suppressed in the flame front stage portion, and in a downstream side of an ignition zone 15, oxygen is consumed by combustion reaction at the central portion of the pulverized coal flame and reducing flame 17 of low oxygen concentration is formed.

Further, since oxygen consumption does not progress in a radially outer side of the reducing flame 17 because of low oxygen concentration, oxidizing flame 16 of high oxygen concentration is formed. Further, in the flame rear stage portion, when the air jetted from the air nozzles and the pulverized coal flowing at the central portion of flame are mixed, since oxygen consumption has progressed in the flame front stage portion composed of the reducing flame and the oxidizing flame, the reducing flame of low oxygen concentration spreads in the radial direction in the flame rear stage portion.

In this manner, in order to flow air jetted from the air nozzles separately from the central axis in the flame front stage portion and mix it with pulverized coal flowing at the center in the flame rear stage portion, the above-mentioned air is jetted at an angle of at least 30° but no more than 50° to the central axis of the pulverized coal nozzle.

Therefore, since the majority of pulverized coal passes in the reducing zone, NOx produced by the oxidizing flame of the flame front stage is also reduced. Further, a distribution of air becomes uniform as compared with the case where air is jetted from an air nozzle 11 at an angle of less than 30° to the central axis of the pulverized coal nozzle, so that a zone of an extremely low gas phase air ratio is not formed. Therefore, combustion reaction progresses, and improvement of combustion efficiency and reduction of unburnt carbons in combustion ashes are brought about. Further, since combustion reaction of pulverized coal has progressed before mixing with second stage combustion air, NOx occurring by mixing with the second stage combustion air becomes small.

EMBODIMENT 6

Figure 12A:
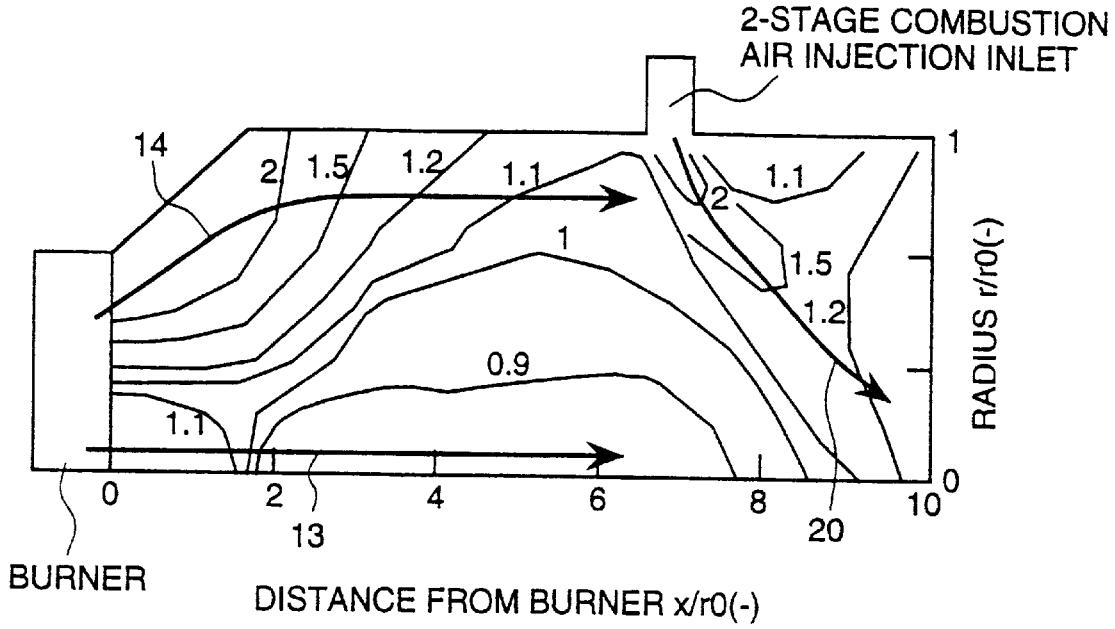
FIG.12A PRIOR ART
FIGS. 12A and 12B each are a diagram of a gas phase air ratio distribution.
Figure 12B:
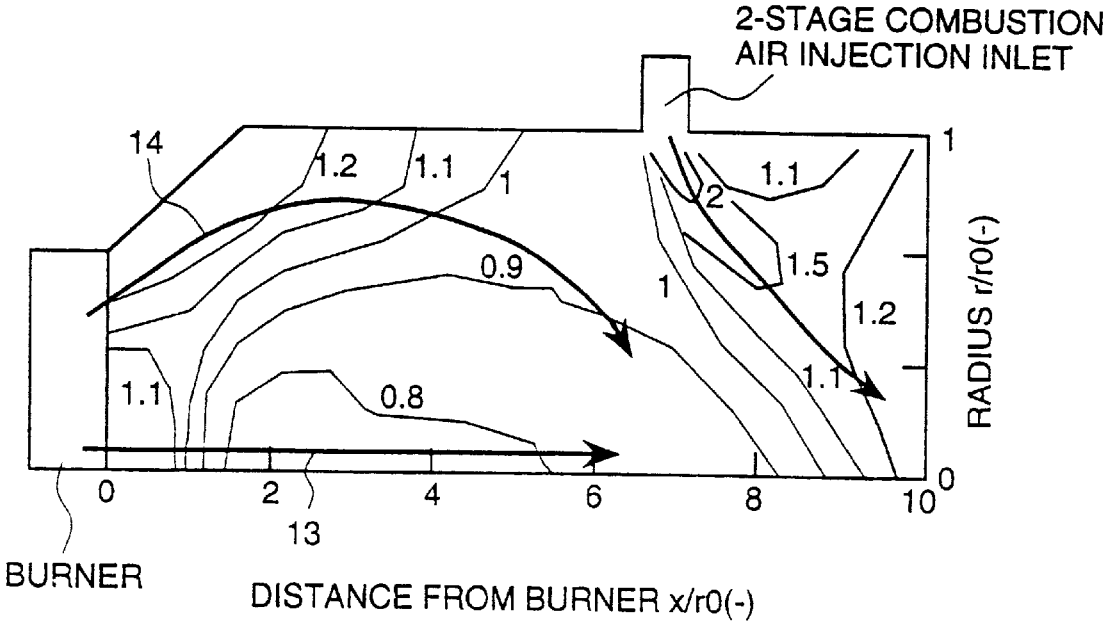

FIGS. 12A and 12B show comparison of gas distribution inside the pulverized coal furnace by a conventional burner and an embodiment of the present invention. Here, gas phase air ratios are shown as gas concentration distribution. As mentioned above, the gas phase air ratio is a ratio of a real air quantity and a quantity of air necessary for complete combustion of components discharged as gas from pulverized coal. A zone of gas phase air ratio of 1 or less represents reducing flame of low oxygen concentration, and a zone of 1 or more represents oxidizing flame. The gas phase air ratio is calculated by obtaining each element amount from the concentration of gas components and from oxygen atomic numbers necessary for complete combustion of the each element and oxygen atomic numbers really contained in the gas components.

FIGS. 12A and 12B each show a section taken along a central axis of a cylindrical furnace. The lower side of each of FIGS. 12A and 12B, the upper side thereof and the right end thereof represent the central axis, the furnace wall and the furnace outlet, respectively. The pulverized coal burner is mounted on the left end of the furnace in FIGS. 12A, 12B, and an air injection inlet for second combustion air is provided on a furnace side wall downstream by about 6 m from the pulverized coal burner.

Figure 13A:
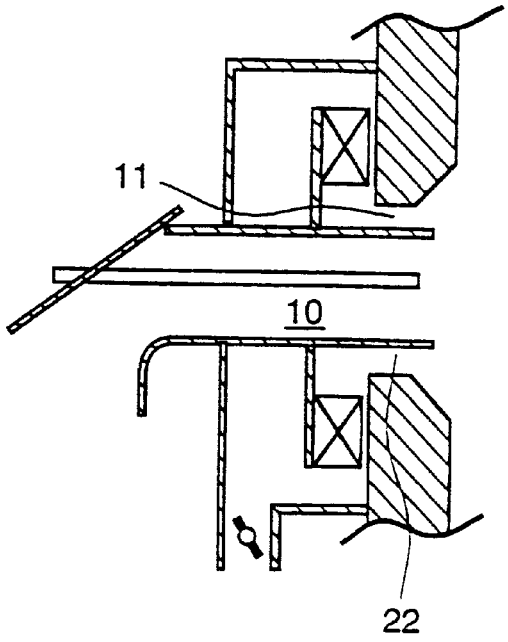
FIG. 13A PRIOR ART
FIGS. 13A and 13B each are a vertical sectional side view of a conventional pulverized coal combustion burner and a pulverized coal combustion burner of the present invention, respectively.
Figure 13B:
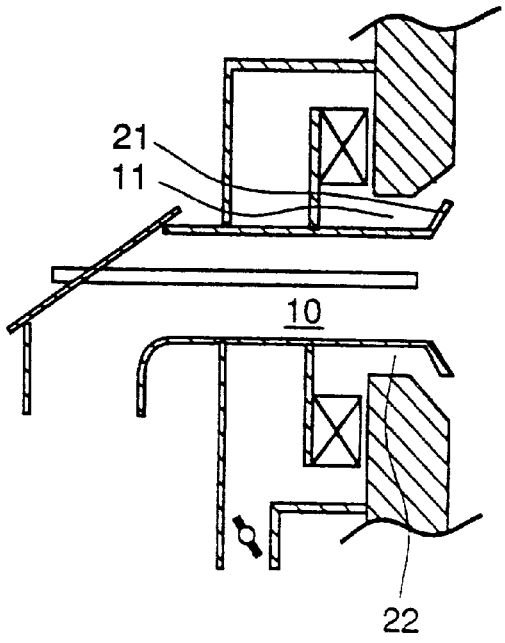

FIG. 12A is a distribution of gas phase air ratios in the case where the conventional pulverized coal burner shown in FIG. 13A is used, and FIG. 12B is the distribution of gas phase air ratios in the case where the pulverized coal burner of the present invention shown in FIG. 13B is used.

In the conventional pulverized coal burner shown in FIG. 12A and FIG. 13A, strong swirling is imparted to the air jetted from the air nozzle of the burner, and the air flows closely to the side wall separate from the central axis, as shown by an arrow of FIG. 12A. Therefore, gas phase air ratios in the zone from the burner to a position 6 m separate from the burner are separated into oxidizing flame of more than 1 in the vicinity of the side wall and reducing flame of less than 1 near to the central axis.

On the contrary, in the pulverized coal burner of the present embodiment shown in FIG. 12B and FIG. 13B, the air jetted from the air nozzle of the burner has weak swirl imparted as compared with the conventional burner, and it is jetted in a direction separating from the pulverized coal nozzle at an angle of at least 30° but no more than 50° to the central axis of the pulverized coal nozzle. Therefore, as shown by an arrow in FIG. 12B, air jetted from the air nozzle 11 flows separately from the central axis near the burner (in the zone from the burner to a position distanced by 3 m from the burner) and flows toward the central axis at a downstream side of the zone. Therefore, a reducing flame zone of a gas phase air ratio of 1 or less spreads radially inside the furnace at a flame downstream side, that is, in the zone before the injection inlet for second stage combustion air.

Therefore, since the majority of pulverized coal passes in the reducing zone, NOx produced by the oxidizing flame of the flame front stage is also reduced. Further, a distribution of air becomes uniform as compared with the conventional burner as shown in FIG. 12A, so that a zone of an extremely low gas phase air ratio is not formed. Therefore, combustion reaction progresses, and improvement of combustion efficiency and reduction of unburnt carbons in combustion ashes are brought about. Further, since combustion reaction of pulverized coal has progressed before mixing with second stage combustion air, NOx occurring by mixing with the second stage combustion air becomes small.

As explained above, with the pulverized coal combustion burner or by the combustion method, as mentioned above, air is jetted from the air nozzle in flow to an outer peripheral direction (in a direction separate from the pulverized coal nozzle) with respect to the central axis of the pulverized coal nozzle. The air jetted thus flows separately from the center in a front stage portion of the flame and then flows toward the center of the flame in a rear stage portion of the flame (at a position separated from the burner nozzle outlet by a distance more than three times as long as the burner throat diameter).

In a downstream side of an ignition zone, oxygen is consumed by combustion reaction at the central portion of pulverized coal flame and a reducing flame of low oxygen concentration is formed. Further, since oxygen consumption does not progress in a radially outer side of the reducing flame because of low oxygen concentration, oxidizing flame of high oxygen concentration is formed. Further, in the flame rear stage portion, when air jetted from the air nozzle and pulverized coal flowing at the central portion of flame are mixed, since oxygen consumption has progressed in the flame front stage portion composed of the reducing flame and the oxidizing flame, the reducing flame of low oxygen concentration spreads in the radial direction in the flame rear stage portion.

Therefore, since the majority of pulverized coal passes in the reducing zone, NOx produced by the oxidizing flame of the flame front stage is also reduced and a distribution of air becomes uniform, so that a zone of an extremely low gas phase air ratio is not formed. Therefore, combustion reaction progresses, and it becomes possible to carry out improvement of combustion efficiency and reduction of unburnt carbons in combustion ashes.

According to the present invention as has been explained above, a pulverized coal combustion burner and a combustion method by the burner can be obtained, in which occurrence of NOx is small and unburnt carbons in combustion ashes are small.

What is claimed is:

1. A combustion method by a pulverized coal combustion burner having a pulverized coal nozzle for injecting a mixture of pulverized coal and air and an air nozzle for injecting air through an injection port, said air nozzle being positioned at an outer peripheral portion of said pulverized coal nozzle so as to surround said pulverized coal nozzle, characterized in that air is jetted from said air nozzle in a weak swirling stream of a swirl number of 0.8 or less in a direction separating from said pulverized coal nozzle at an angle in a range between 30° and 50° to the central axis of said pulverized coal nozzle, a ratio jetting speed of air jetted from said air nozzle to a jetting speed of said mixture fluid is in a range between 2:1 and 3:1, and a combustion flame formed by said pulverized coal burner has a first zone of a gas phase air ratio of one or less formed at a radially central portion of the flame and a second zone of a gas phase air ratio of larger than one formed outside said first zone, adjacent said injection port of said pulverized coal combustion burner, and a third zone of a gas phase air ratio of one or less formed inside said flame at a downstream side of said first and second zones.

2. A combustion method by a pulverized coal combustion burner, formed so as to effect two stage combustion and provided with a pulverized coal combustion burner having a pulverized coal nozzle for injecting a mixture of pulverized coal and air and an air nozzle for injecting air through an injection port, said air nozzle being positioned at an outer peripheral portion of said pulverized coal nozzle so as to surround said pulverized coal nozzle, and an air supply means, arranged at a downstream side of said pulverized coal combustion burner, for supplying second combustion air, characterized in that a substoichiometric quantity of air less than an air quantity necessary for complete combustion of the fuel supplied from said pulverized coal nozzle is supplied from said air nozzle, air is jetted from said air nozzle in a weak swirling stream of a swirl number of 0.8 or less in a direction separating from said pulverized coal nozzle at an angle in a range between 30° and 50° to the central axis of said pulverized coal nozzle, a ratio jetting speed of air jetted from said air nozzle to a jetting speed of said mixture fluid is in a range between 2:1 and 3:1, and a combustion flame formed by said pulverized coal burner before mixing with said second combustion air has a first zone of a gas phase air ratio of one or less formed at a radially central portion and a second zone of a gas phase air ratio of one or larger formed outside said first zone, adjacent said injection port of said pulverized coal combustion burner, and a third zone of a gas phase air ratio of one or less formed inside said flame at a downstream side of said first and second zones.

3. A combustion method by a pulverized coal combustion burner, formed so as to effect two stage combustion and provided with a pulverized coal combustion burner having a pulverized coal nozzle for injecting a mixture of pulverized coal and air and an air nozzle for injecting air, said air nozzle being positioned at an outer peripheral portion of said pulverized coal nozzle so as to surround said pulverized coal nozzle, and an air supply means, arranged at a downstream side of said coal nozzle of said pulverized coal combustion burner, for supplying second combustion air, characterized in that a substoichiometric quantity of air less than an air quantity necessary for complete combustion of the fuel supplied from said pulverized coal nozzle is supplied from said air nozzle, a pulverized coal mixture fluid is jetted and supplied in a straight stream from said pulverized coal nozzle, air is jetted from said air nozzle in a straight stream without being swirled or in a weak swirling stream of a swirl number of 0.8 or less in a direction separating from said pulverized coal nozzle at an angle in a range between 30° and 50° to the central axis of said pulverized nozzle, a ratio jetting speed of air jetted from said air nozzle to a jetting speed of said mixture fluid is in a range between 2:1 and 3:1, and a combustion flame formed by said pulverized coal burner before mixing with said second combustion air has a first zone of a gas phase air ratio of one or less formed at a radially central portion and a second zone of a gas phase air ratio of one or larger formed outside said first zone, and third zone of a gas phase air ratio of one or less formed inside said flame at a downstream side of said first and second zones.

4. A combustion method by a pulverized coal combustion burner provided with a pulverized coal nozzle for injecting a mixture of pulverized coal and primary air and an air nozzle for injecting air, said air nozzle being positioned at an outer peripheral portion of said pulverized coal nozzle so as to surround said pulverized coal nozzle, said air nozzle being composed of a secondary air nozzle for jetting secondary air and a tertiary air nozzle arranged to be separated from and surround said secondary air nozzle for jetting tertiary air, characterized in that the secondary air is jetted from said secondary air nozzle, the tertiary air is jetted from said tertiary air nozzle in a weak swirling stream of a swirl number of 0.8 or less in a direction separating from said pulverized coal nozzle at an angle in a range between 30° and 50° to the central axis of said pulverized coal nozzle, a ratio jetting speed of air jetted from said air nozzle to a jetting speed of said mixture fluid is in a range between 2:1 and 3:1, and a combustion flame formed by said pulverized coal burner has a first zone of a gas phase air ratio of one or less formed at a radially central portion of the flame and a second zone of a gas phase air ratio of larger than one formed outside said first zone, adjacent said coal nozzle, and a third zone of a gas phase air ratio of one or less formed inside said flame at a downstream side of said first and second zones.

5. A combustion method according to claim 4, wherein a quantity of the secondary air from said secondary air nozzle is about one third of a quantity of the tertiary air from said tertiary air nozzle.

* * * * *